United States Patent [19]

Sprout

[11] 3,941,041

[45] Mar. 2, 1976

[54] UPDRAFT EXHAUST SYSTEM

[76] Inventor: Elmer E. Sprout, 10749 Gail Court, St. Louis, Mo. 63123

[22] Filed: May 22, 1974

[21] Appl. No.: 472,100

[52] U.S. Cl. ..... 98/115 R; 104/52; 137/580; 137/615

[51] Int. Cl.[2] ..... F23J 11/00

[58] Field of Search ... 98/115 R, 115 VM; 137/580, 137/615; 104/52

[56] References Cited

UNITED STATES PATENTS

| | | | |
|---|---|---|---|
| 504,511 | 9/1893 | Anderson | 98/115 R |
| 506,205 | 10/1893 | Call et al. | 98/115 R |
| 899,667 | 9/1908 | Harcourt | 98/115 R |
| 1,316,637 | 9/1919 | Ouzoun-Boghossian | 137/615 |

FOREIGN PATENTS OR APPLICATIONS

| | | | |
|---|---|---|---|
| 221,870 | 6/1959 | Australia | 137/615 |

*Primary Examiner*—Carroll B. Dority, Jr.
*Assistant Examiner*—Ronald C. Capossela
*Attorney, Agent, or Firm*—Rogers, Ezell & Eilers

[57] ABSTRACT

An exhaust stack engageable with engine exhausts, having an upper outlet section extending through a building wall, with means to prevent rain from descending in the stack; having also an intermediate section with a vertical pipe telescoped into the upper section and a horizontal extension thereon; and having further a lower, inlet section having a horizontal section telescoped into the horizontal extension of the intermediate section, the lower end of the inlet section having centering means so that it can be lowered over an engine exhaust pipe to center it and provide an annular space around the exhaust pipe. The intermediate and lower sections are supported for vertical adjustment by a hoist that is tracked around the upper section for angular adjustment. The lower section is horizontally adjusted into the intermediate section and transport means are provided for the adjustment. A temperature senser is provided near the inlet. The piping can all be rigid, heavy metal throughout.

14 Claims, 14 Drawing Figures

9
12
16
23
25
27
28
35
40
41
42
43
45
46
50
51
52
55
56
57
58
60
65
66
67
68
69
70
71
72
73

UPDRAFT EXHAUST SYSTEM

BACKGROUND OF THE INVENTION

Heretofore the principal types of exhaust ducting or stacking used in repair shops for motor vehicles and especially for diesel engines have been formed of relatively light sheet metal or other such material with flexible tubular elbows or other sections to permit the inlet end of the stacking to be moved onto the exhaust pipe of the engine. Some degree of movability is required of the inlet of such stacking because of the varying positions of the engine when vehicles are driven into the work positions. A principal deficiency of the former stacking is that the intense heat of the engine exhausts very soon destroys the stacking, particularly in the elbows or curved parts, which are subjected to the inertia of the gases at very high temperatures, in order the deflect them, and which are inherently weakened by being required to flex.

Where heretofore there have been telescopic stacking, it has usually been of very limited movability.

Advantages of the Present Invention

The present invention in the first place is designed so that it can achieve extensive mobility and adjustability of the inlet end and yet can be made of heavy steel piping. It is designed so that the inlet can be moved horizontally, vertically and angularly despite being made of rigid piping.

Furthermore, the vertical movement and the horizontal movements are made by members with mechanical advantage so that an operator can easily perform their adjustments. The angular adjustment is relatively friction-free, comprising circular tracks and rollers that operate on the tracks to give a full 360° rotation.

Other features include the means to provide automatic centering of the inlet pipe over the exhaust pipe of the engine in a manner to provide an annular space all around the exhaust pipe within the inlet so that cooling gases can be entrained from the room around the exhaust pipe and into the stacking system, and also to enable the mechanic to see the emitting gases. Immediately above the exhaust pipe is disposed a special small tube containing a temperature-sensing device so that the temperature of the exhaust gases can be obtained at the time they leave the engine.

Another feature of the invention is that the stacking may extend through the roof of a building and vertically thereabove to conduct the gases high enough in the air to avoid pollution near the earth. Means are provided to prevent rain from descending through the stacking where it could enter the building or even enter the exhaust pipes of the engine.

Other advantages will appear from the description to follow.

IN THE DRAWINGS

DETAILED DESCRIPTION OF THE PREFERRED EMBODIMENT

Figures 1, 2, 3, 4, 5, 14:
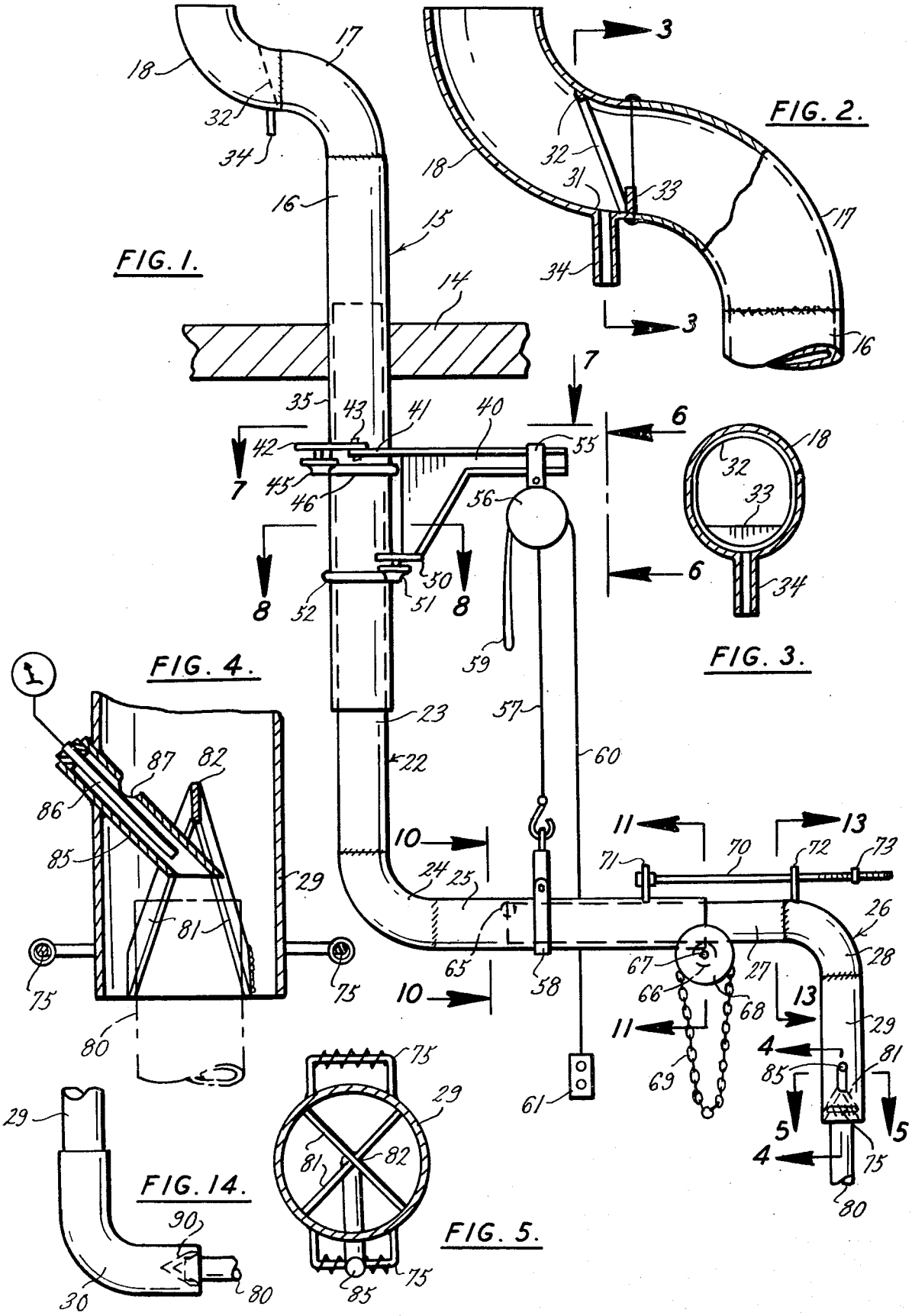
FIG. 1 is an elevation of the stacking extending through the roof of a building and down to an engine exhaust pipe.
FIG. 2 is an enlarged vertical section through the upper outlet parts of the stacking.
FIG. 3 is a broken vertical section on the line 3—3 of FIG. 2.
FIG. 4 is an enlarged vertical section through the inlet part of the stacking at the bottom of FIG. 1.
FIG. 5 is an enlarged horizontal section showing the inlet at the bottom of FIG. 1.
FIG. 14 is a sketch showing the use of a supplemental horizontal elbow for engagement with horizontal exhaust pipes.

In FIG. 1, the overall elevational view of the present updraft exhaust system, a roof 14 of a building has an opening therethrough in which a first or upper section 15 of the present duct system passes, and is secured in place by conventional means, not shown. This upper section 15 is usually vertical, but may pass through a wall rather than a roof and may be non-vertical. It includes a vertical pipe 16 having in its outlet upper end first and second elbows 17 and 18. At the bottom of this vertical pipe 16 a right angular intermediate section 22 has its vertical position 23 telescoped slidably within the vertical pipe 16 of the upper section 14. This vertical pipe 23 is connected by an elbow 24 to a horizontal portion 25. The lowest section 26 of the system comprises a horizontal pipe 27 telescoped into the horizontal pipe 25 of the intermediate section 22, an elbow 28, and a vertical portion 29 adapted to fit over the exhaust pipe of an engine. If desired, a further elbow section 30 may be provided to permit the device to be installed over horizontal exhaust pipes.

The exhaust gases are directed vertically upwardly by the system through the upper section 15, toward the sky. This opens the top of the system to the ingress of rain. Provision of the two elbows prevents rain from falling directly down into the parts of the stack assembly inside the building. The rain is received by the inner walls of the elbow 18, and runs down them toward their lowest side. A welded ridge 32 is provided around the interior of the elbow 18, at the lower portion thereof, so that water running down the walls is deflected to the lowest side of the elbow 18. There a low dam 33 extends upwardly a sufficient distance to collect all the rainwater that may descent in the pipe section 31. A drain tube 34 is provided adjacent the dam on its outlet side to carry this water out of the system and permit it to fall onto the roof or to another place where it may be conducted to the ground.

The various components of each of the piping sections are secured together as by welding or other means that will make tight connections. This piping is preferably made of steel, and is desirably of large diameter. Typical sizes for the upper section are 14 in. o.d. with ¼ in. thick walls; for the intermediate section are 13 in. o.d. with 3/16 in. thick walls; for the lower section are 12 in. o.d., with 3/16 in. thick walls. It is important to have piping that can withstand high exhaust gas temperatures without significant deformation or loss of strength.

Means are provided for vertically supporting the intermediate section 22, for raising and lowering it, and for permitting it along with the lower section to be swung around the axis of the top section 15 into which it is telescoped. This comprises a hoist that may be electrically operated, manually operated, or both, mounted on the vertical pipe 16 on the top section 15, for rotation about that pipe section.

The hoist arrangement comprises an arm or beam 40 which has a wide vertical web section lying along the pipe 16. It is provided with a ring portion 41 (FIGS. 1, 7) that surrounds the pipe 35 with sufficient clearance to permit its free movement about the pipe. The ring portion may be made in two sections with an outer section 42 in the shape of a half ring bolted at 43 to the portion 41 integral with the beam itself. This arrangement permits the device to be assembled on an existing vertical stack pipe readily, as otherwise it would have to be inserted over the end of the pipe which may not be accessible. The outer portion of the ring 41, which may be the section 42, supports two flanged rollers 45 that are adapted to ride on a track 46 formed by welding round stock around the pipe section 16.

The lower end of the web of the arm 40 has a laterally extending arcuate portion 50 (FIGS. 1, 8) that supports two flanged rollers 51 that ride upon another track 52 also comprising round stock welded around the pipe section 16. Since these components are quite heavy, the flanged rollers 45 and 51 give vertical support to the arm and the elements attached to it. Also, they support the cantilever forces on the arm 40 that act to pull the upper part of the arm 40 away from the pipe and to compress the lower end of the web against the pipe. These rollers ride on thin tracks to enable the beam 40 to be revolved around the pipe 16.

Figures 6, 7, 8, 9, 10, 11, 12, 13:
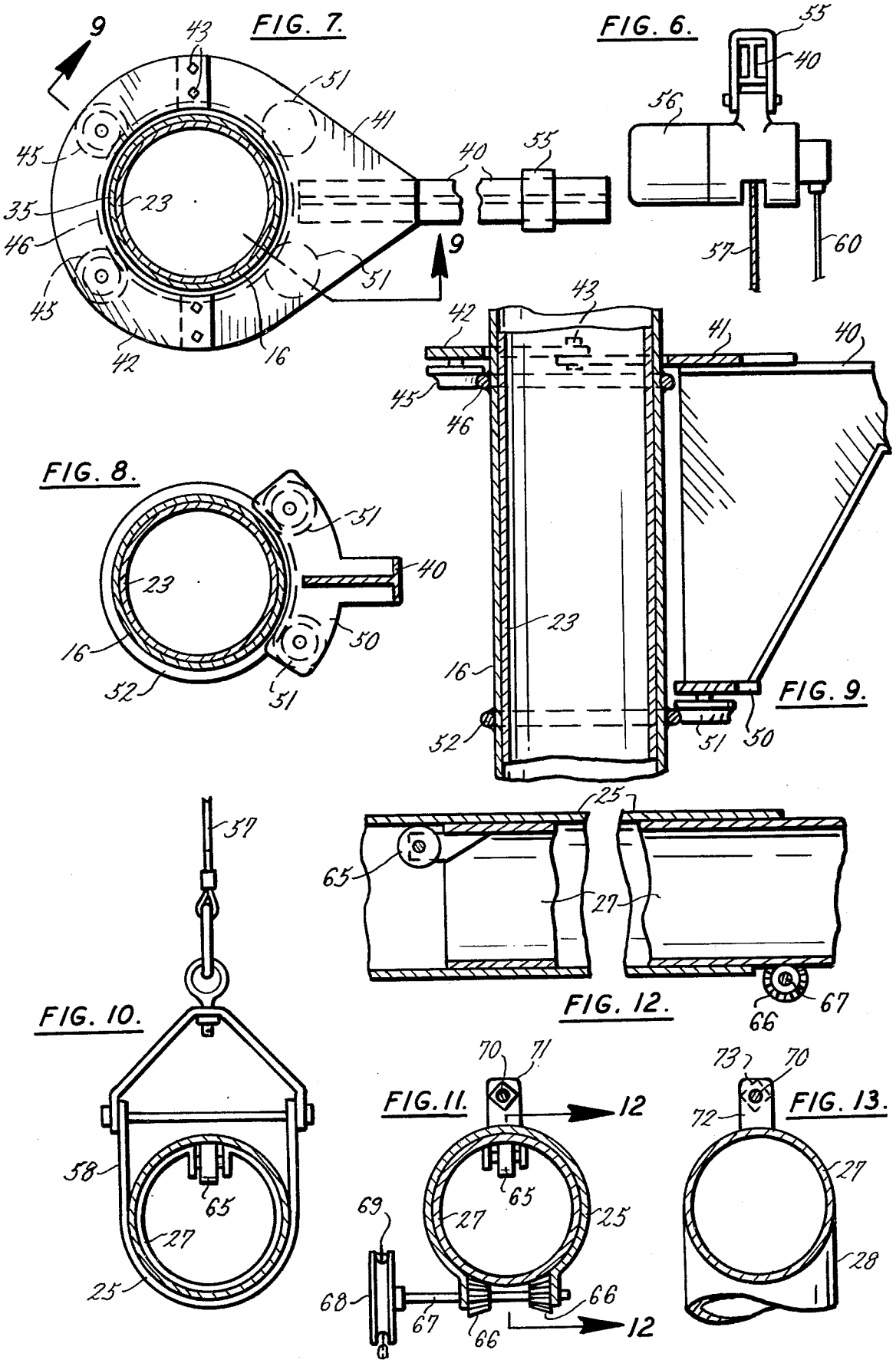
FIG. 6 is a fractional elevation viewed from the right at the middle of FIG. 1 and showing the hoist mechanism.
FIG. 7 is an enlarged horizontal section looking downward on the top of the hoist support, taken on the line 7—7 about the middle of FIG. 1.
FIG. 8 is a similar section taken lower on the hoist support along the line 8—8 of FIG. 1.
FIG. 9 is a vertical section approximately on the line 9—9 of FIG. 7, showing details of the hoist support.
FIG. 10 is an enlarged vertical section through the intermediate piping taken on the line 10—10 toward the lower part of FIG. 1.
FIG. 11 is an enlarged vertical section on the line 11—11 of FIG. 1, to the right of the section of FIG. 10 showing the transport means.
FIG. 12 is a vertical section through the horizontal piping taken on the line 12—12 of FIG. 11.
FIG. 13 is a vertical section taken on the line 13—13 to the lower right of FIG. 1.

The outer end of the beam 40 receives a loop 55 (FIGS. 1, 6) through which the arm 40 extends. This loop supports a manual, electrical or combination chain-lift or hoist 56. This chain lift is shown in FIG. 6 as incorporating a reversible electric motor. It has a chain or cable 57 that has a hook at its end supporting a loop hanger 58 that surrounds and supports the horizontal pipe 24 of the intermediate section 22. A chain 59 may be provided for manually operating the chain lift. Also the lift has a cable 60 connected to a manual switch 61 operating the lift to raise or lower the cable 57. The loop brackets 55 and 58 can be adjusted inwardly or outwardly from the axis of the vertical pipe 16 so that there is a maximum degree of balance in supporting the intermediate section 22 and the lower section 26. The hoist is not reversible by the weight it supports, and it may be provided with brakes and a counterweight as desired.

The lower section 26 has its horizontal pipe 27 telescopically slidable within the horizontal pipe 25 at the bottom of the intermediate section 22. The extreme end of the pipe 27 is provided with a roller 65 (FIGS. 1, 10–12) that can engage against the inner surface of the horizontal pipe 25 at its top side. It will be observed that the weight load of the lowermost section 26 would tend to warp this inner end of the pipe upwardly, so that this wheel acts as an anti-frction member.

The pipe 27 is supported at the open end of the pipe 25 by a transporting means (FIGS. 1, 11) that can move the inner pipe 27 in or out of the pipe 25. This transporting means consists of a pair of bevelled gears 66 that are mounted on a shaft 67 supported at the lower part of the pipe 25. The shaft 67 in turn can be rotated by a chain-driven pulley 68 with a chain 69. The function of the teeth on the bevelled gear 66 is to give a gripping action on the inner pipe 27 to insure that rotation of these bevelled gears will move the pipe 27 in or out of the pipe 25.

An adjustable limiting means is provided to keep the pipe 27 from being completely moved out of the pipe 25. This consists of a rod 70 supported on a bracket 71 mounted on the outside of the pipe 25 and fitting through another bracket 72 mounted on the pipe 27 (FIGS. 1, 11–13). An adjustable stop member 73 is threaded onto the rod 70 and is positioned to be abutted by the bracket 72 at the maximum outward position of the bottom pipe 27.

The pipe 27 is provided with the elbow 28 and the vertical portion 29. This portion 29 is given handles 75 by means of which it may be held and moved onto an exhaust pipe 80, that is part of a diesel engine being worked upon. The lower open end of the pipe 29 has upwardly sloping cross bars 81 that are attached at their lower ends to the inner surface of the pipe 29 (FIGS. 4, 5) and converged upwardly to a common apex 82. They therefore properly center the pipe 29 onto the pipe 80, when the pipe 29 is lowered onto that pipe. A tube 85 extends angularly into the pipe 29 and terminates at the axis thereof. It is designed to hold a themocouple 86 which is thereby subjected to the exhaust gases from the exhaust pipe 80. The pipe 85 has a port 87 in its side so that there can be a flow of gases over the thermocouple.

When the additional horizontal extension 30 is used, it should be fitted snugly over the lower end of the pipe 29 because tiss permits it to be used without removing the tapered or conical centering members 81. Similar centering members 90 can be provided in it.

Use and Operation

The installation of this equipment includes mounting the upper pipe 16 through the roof 14 as a permanent installation. The beam 40 is installed on the pipe 16. If the ring 41 of the beam 40 is made in one piece, it must be inserted over the pipe 16 before that pipe is secured into the roof 14, or must be warped into position from below. If the ring is made in two pieces as illustrated, it is bolted around the pipe in such fashion that the rollers 45 and 51 ride on the two tracks 46 and 52. The hoist 56 is located in place, and can be lowered so that its hook is engaged in the eye on the loop or hanger 58 through which the horizontal portion 25 of the intermediate pipe section 22 is inserted. The hoist is caused to lift the pipe intermediate section 22 and the lower section 26 with it, the vertical pipe 23 being inserted telescopically within the lower portion of the upper pipe 16. The hoist 56 is operated to raise the subassembly until the lowest pipe 29 is slightly higher than the upstanding end 80 of the engine exhaust pipe.

The chain 69 of the tracking means 68 is then operated to cause the internal horizontal pipe 27 of the lower section 26 to be telescoped into or out of the horizontal pipe 25 of the intermediate section 22, to bring the vertical pipe 29 a proper radial distance from the axis of the vertical pipe 16 to correspond to the radial distance of the exhaust pipe 80 therefrom. Simultaneously the whole intermediate and lower sections are swung around by rotation of the beam 40 on its rollers 45 and 51 on the tracks 46 and 52 until the pipe 29 has its axis as nearly as possible directly above the exhaust pipe 80. Thereupon the hoist 56 is lowered to bring the end of the pipe 29 down onto the exhaust pipe 80. As it descends, the angular centering members 81 engage over the upper rim of the exhaust pipe 80, causing a true centering of the pipe 29 on the exhaust pipe 80 with a reasonably uniform annular opening around the exhaust pipe.

In the event the exhaust pipe 80 happens to be horizontal, the alignment is made as indicated in FIG. 14 and it will be understood that the same movements of the mechanism occur except that the chain 59 of the transport means 68 is used to bring the pipe 29 onto the exhaust pipe 80.

With this arrangement, the engine exhaust is directed up the stack assembly. As shown by FIG. 4, the exhaust discharges directly into the lower end of the small pipe or tube 85 where it flows through that tube around the thermocouple, and rejoins the stack gas stream through the hole 87. It thus causes the thermocouple 86 to register the temperature of the exhaust gas. The exhaust being directed up the stack entrains air from the room through the annular space around the exhaust pipe 80 within the pipe 27. This has the advantage of keeping the whole piping stack cooler, as well as providing exhaust of air from the room.

This stack, being counterbalanced or operated mechanically both in horizontal, vertical and rotary movements, can be made of heavy steel rather than light sheet material. It can withstand a very high temperature of exhaust gases without deformation of a serious nature, and without being soon destroyed by the excessive heat. This advantage is especially notable in the elbows, which heretofore have had to be made of thin, flexible material, much better than previously-used stacks. This durability is enhanced by the foregoing entrainment of cooling air with the exhaust.

Fire hazard is reduced by this stack, since the stack, especially the elbows, are unlikely to become red hot and therefore cannot ignite material coming in contact with them. The fire hazard is also reduced in the present mechanism because it does not require flimsy flexible connections to make it engage over the engine exhaust pipe.

The present stack also operates without requiring fans or blowers to keep it cool. It can be made, as noted, of heavy material so that it can withstand harder service, and no mechanical strains are put upon the elbows or other such parts of it in order to locate the inlet on the engine exhaust pipe. The stack is made of much larger diameter piping that does not tend to clog up with deposits or soot, and it if does, it can easily be cleaned. Normally it is self-cleaning.

Heretofore, it has been a practice in many cases to use flexible piping that can be brought to the engine exhaust from fixed piping attached through the wall of the building, regardless of variations in the position of the engine. The present invention accommodates such variations without requiring such flexible extensions because it provides universal horizontal, vertical and angular adjustments to position the inlet pipe 89.

The present invention can have a low noise level. The noise and fumes are discharged high into the atmosphere. A muffler can be used if desired. Rainwater, as noted, is not permitted to come down into the building, but is drained off at the top section.

In addition to providing for the entrainment of gases, the large lower entry portion of the pipe 29 permits the mechanic visually to observe the condition of the exhaust emitting from the exhaust pipe while he is adjusting and testing the engine. At the same tme he can measure the temperature of the exhaust by the pyrometer 86, it being noted that the pyrometer is located at the point to be observed while the visual condition of the exhaust also is seen.

There are other structural advantages to the present device. It is made of simple sections that can be easily obtained and fabricated by ordinary shop tools such as welders, cutting torches, electric drills and the like. It has few moving parts to wear out. The telescoping portions that are horizontal can be provided with antifriction rollers as noted. The rollers are readily available for servicing and the system requires very little space and lends itself to being mounted through the roof or wall adjacent the side of a room so that when not in use, it can be stored by having the intermediate and lower parts 22 and 26 swung near the wall, the remaining parts being elevated out of the way. It can be used in multiples in the column line of buildings that employ overhead travelling bridge cranes, because it can be mounted through the roof to one side of the bridge crane tracking. Usually it can be located to work in the same area as post or jib-type hoists, which is an advantage of the central support and 360° rotation features.

Various changes and modifications may be made within this invention as will be readily apparent to those skilled in the art. Such changes and modifications are within the scope and teaching of this invention as defined by the claims appended hereto.

What I claim is:

1. In a stack assembly for use in conducting noxious gases from an enclosure: piping having an outlet portion adapted to be fixed to a wall of the enclosure to discharge therethrough, the piping having an inlet for disposition over the end of an exhaust or like pipe as of a vehicle engine having variable positions; the piping having rigid but movably interfitting portions providing means for horizontal, vertical, and angular movements of the inlet, relatively to the outlet portion, the last-named including vertically telescoped pipe portions, one rotatable in the other, and means for holding them against separation while permitting them relative rotation about their common vertical axis, and incorporating suspension means for suspending the rest of the piping from the outlet portion.

2. In the stack assembly of claim 1: the means for angular movements including the aforesaid vertical piping portion between the outlet portion and the inlet, adapted to be held against vertical movements, and the intermediate piping section having a vertical part telescoped into the vertical piping portion, an elbow connected to the vertical part and a horizontal part extending from the elbow; and the suspension means including a crane mounted on the vertical piping portion, having support mechanism to enable the crane to swing about the vertical portion, a hoist on the crane extending to the horizontal part of the intermediate piping section whereby the intermediate piping section can be supported by the crane for the angular movement about the vertical piping.

3. In the stack assembly of claim 2: an inner piping section telescoped into the horizontal part of the intermediate piping section for horizontal displacement, the inlet being a part of the inner piping section.

4. In the stack assembly of claim 3: means for limiting the horizontal movement of the inner pipe section to prevent its coming out of the intermediate section.

5. The stack assembly of claim 3 plus means for producing the telescopic movement of the inner pipe section.

6. In the stack assembly of claim 5: the means producing telescopic movement comprising rollers on the intermediate section engaging under and supporting the inner piping section, at the top thereof engageable with the inner surface of the intermediate pipe section.

7. In the stack assembly of claim 1: the piping including an upper vertical portion and a lower horizontal portion, the hoisting mechanism comprising a crane, means mounted on the upper portion for supporting the crane, and the crane overhanging and being attached to the lower portion to support it from the upper portion and to enable it to rotate.

8. In the assembly of claim 7: the crane means comprising a beam extending outwardly from the upper portion, an upper track and a lower track around that portion, means on the beam extending around to the opposite side of the upper portion, having rollers engaging the upper track; means on the beam having rollers on the same side of the upper portion engaging the lower track; at least one of the said rollers having flanges engaging above the upper side of the track; the beam being rotatable about the upper portion by engagement of the rollers on the tracks.

9. In the stack assembly of claim 1: the outlet portion of the assembly having means to conduct water from inside the outlet through a wall thereof to outside the assembly.

10. In the stack assembly of claim 9: the outlet portion having a vertical part opening upwardly, the said part being offset from the rest of the outlet portion and having a bottom wall below the opening, to prevent direct falling of rain down the assembly, and means in the bottom wall of the outlet to collect water and conduct it through a wall thereof to outside the assembly.

11. In the stack assembly of claim 1: the inlet having upwardly converging inner elements within its walls that can removably engage the vehicle exhaust pipe and by contact center the inlet over the same, the elements providing flow passage past them.

12. In the stack assembly of claim 11: the inlet having a temperature-measuring device receptacle therein supported from the wall thereof, whereby to receive a sensor to enable the temperature of the exhaust gases to be sensed adjacent the outlet of the engine exhaust pipe, the receptacle comprising a conduit extending toward the center of the pipe and having an opening near the center, and another opening within the inlet but outward from the center, whereby to cause exhaust gases to traverse the conduit, so as to influence a sensor therein.

13. In the stack assembly of claim 12: the receptacle being tubular, extending inwardly and downwardly from the wall of the inlet to the middle part thereof, having an opening at its inner end and another opening adjacent the wall, so that it may receive exhaust gases at the middle part of the inlet, conduct them along itself, and discharge them adjacent the wall.

14. In the stack assembly of claim 11: the inlet being relatively large in diameter, and the converging elements being shaped removably to engage a vehicle exhaust pipe of lesser diameter, so that air may be entrained around its inner surface when it is engaged over an exhaust pipe.

* * * * *